US006119493A

United States Patent [19]

Carter et al.

[11] Patent Number: 6,119,493

[45] **Date of Patent: *Sep. 19, 2000**

[54] TAMPER RESISTANT COMBINATION LOCK

[76] Inventors: Robert L. Carter, 3124 Brossman Ct., Naperville, Ill. 60564; George W. Carter, Jr., 5300 Walnut La., Colleyville, Tex. 76034

[ * ] Notice: This patent is subject to a terminal disclaimer.

[21] Appl. No.: 09/034,762

[22] Filed: Mar. 4, 1998

Related U.S. Application Data

[63] Continuation-in-part of application No. 08/853,941, May 9, 1997, Pat. No. 5,899,098, which is a continuation-in-part of application No. 08/584,459, Jan. 11, 1996, Pat. No. 5,640,860.

[51] Int. Cl.[7] ..... E05B 37/16

[52] U.S. Cl. ..... 70/26; 70/23; 70/68

[58] Field of Search ..... 70/25, 64, 68, 70/23, 26, DIG. 80, 20, 24, 432, 438, 441, 446, 331

[56] References Cited

U.S. PATENT DOCUMENTS

| | | | |
|---|---|---|---|
| 603,711 | 5/1898 | Snyder | 70/25 |
| 1,387,750 | 8/1921 | Appleton | 70/25 |
| 1,401,030 | 12/1921 | Ashkar | 70/25 |
| 1,411,123 | 3/1922 | Nadolny | 70/25 |
| 1,503,043 | 7/1924 | Greer | 70/25 |
| 1,686,632 | 10/1928 | Mayer | 70/25 |
| 1,759,283 | 5/1930 | Schmidt | 70/68 |
| 2,101,264 | 12/1937 | Mayer | 70/25 |
| 2,985,005 | 5/1961 | Kahn | 70/25 |
| 3,536,017 | 10/1970 | Lucas | 70/332 |
| 3,580,016 | 5/1971 | Kerr | 70/68 |
| 3,774,227 | 11/1973 | Smilgys | 70/433 |
| 4,829,794 | 5/1989 | Crown | 70/25 |
| 4,862,714 | 9/1989 | Taylor et al. | 70/25 |
| 4,866,958 | 9/1989 | Bretl et al. | 70/25 |
| 4,952,228 | 8/1990 | Taylor et al. | 70/25 |
| 4,959,978 | 10/1990 | Cappell et al. | 70/25 |
| 5,640,860 | 6/1997 | Carter et al. | 70/25 |

FOREIGN PATENT DOCUMENTS

| | | | |
|---|---|---|---|
| 26694 | 9/1920 | Denmark | 70/25 |
| 516059 | 12/1920 | France | 70/25 |

*Primary Examiner*—Teri Pham
*Attorney, Agent, or Firm*—Dillis V. Allen, Esq.

[57] ABSTRACT

An improved tamper resistant combination lock with large planar easy to shift blocking slides with spring fingers that fool the lock picker into believing all three positions of the slides are blocking positions, rather than passing positions. The slides block or pass spaced spheroidal obstructions on a plunger. A small bifurcated clip prevents the complete removal of the plunger when all blocking slides are in the pass position. In one embodiment the lock is a padlock-type with a "U" shaped shackle that lies in a common plane with the slides to reduce lock size.

23 Claims, 7 Drawing Sheets

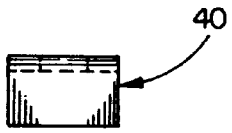
Fig. 14
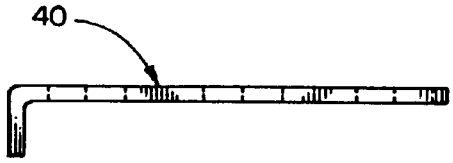
Fig. 15
Fig. 16
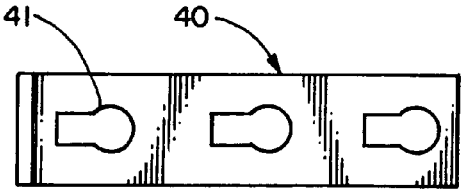
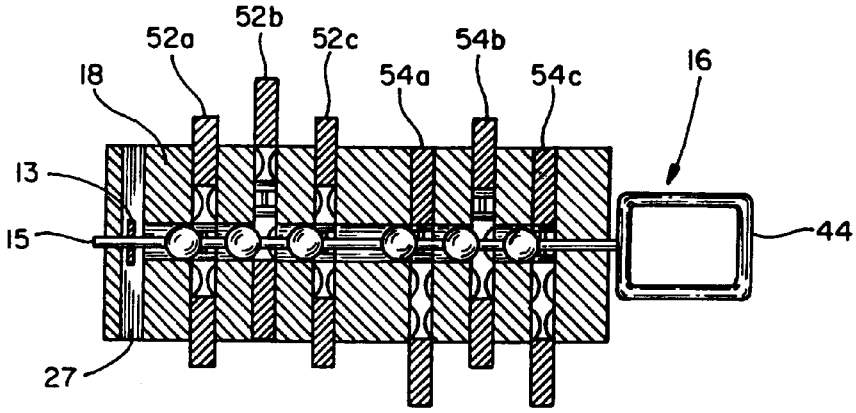
Fig. 17
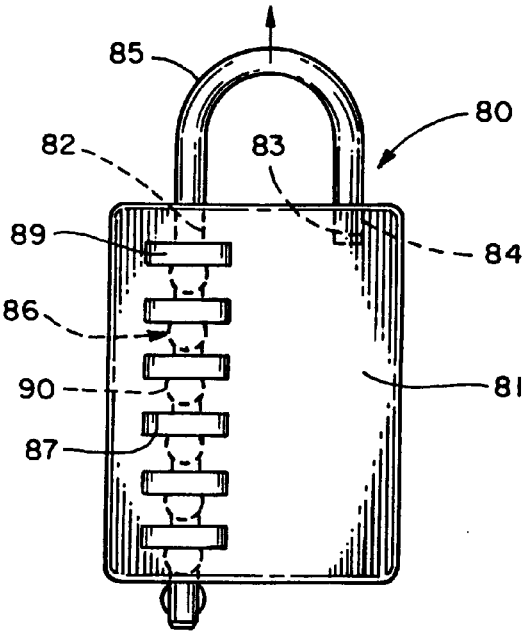
Fig. 18

TAMPER RESISTANT COMBINATION LOCK

RELATED APPLICATION

This application is a Continuation-In-Part of our U.S. Ser. No. 08/853,941, Filed: May 9, 1997, now U.S. Pat. No. 5,899,098, entitled "TAMPER RESISTANT COMBINATION LOCK", which is a Continuation-In-Part of our U.S. Ser. No. 08/584,459, Filed: Jan. 11, 1996, entitled "TAMPER RESISTANT COMBINATION LOCK", now U.S. Pat. No. 5,640,860, Issued: Jun. 24, 1997.

BACKGROUND OF THE INVENTION

Combination locks have, of course, achieved considerable commercial success, but attempts to manufacture and market relatively inexpensive locks have been quite different largely because very inexpensive locks are fairly simple to pick. While the present lock is exemplified as an aftermarket combination lock for pistol cases, the lock has other low costs applications, and hence, the prior art is equally as broad.

A preliminary patentability search resulted in the following collection of U.S. Patents: Enholm, U.S. Pat. No. 428,387; Battershell, U.S. Pat. No. 1,733,772; Legat, U.S. Pat. No. 1,898,974; Ponder, U.S. Pat. No. 2,740,530; Nemsky, U.S. Pat. No. 3,155,230; Esquibel, et al., U.S. Pat. No. 3,514,981; Feinberg, U.S. Pat. No. 3,597,945; Pedro, U.S. Pat. No. 3,865,166; Jones, Re. U.S. Pat. No. 30,139; Ippolito, et al., U.S. Pat. No. 4,187,703; Gordon, U.S. Pat. No. 4,463,847; Terada, et al., U.S. Pat. No. 5,081,855; Jarboe, U.S. Pat. No. 5,125,661; and Blanchard, U.S. Pat. No. 5,322,200.

The Ippolito, et al., U.S. Pat. No. 4,187,703, shows a locking system applied to an envelope defined by a pair of spaced plates, holding a numismatic coin. The Ippolito device has a slide plate 14 with cross slots 16 transversely positioned away from a central longitudinal slot 18. The transversely movable slides are all identical and can be positioned either in a right-hand or left-hand orientation as seen in FIG. 9. This arrangement, however, produces only two positions for each switch and, therefore, yields few combinations.

The Jarboe, U.S. Pat. No. 5,125,661, discloses a plunger-type locking mechanism, but there is really no logic in the lock combination because if all the plungers are depressed, the plunger 19 can be removed regardless of the position of blocks 35. Thus, it is not really a true combination lock at all.

The Esquibel, et al., U.S. Pat. No. 3,514,981, discloses a plunger-type locking mechanism for a box wherein a locking bar 14 is held or released by a plurality of slide bars 13 that have second slots 30 all positioned the same distance from the inner ends of the bars, and first slots 29 positioned in varying locations to correspond to one of the indicia on area 33 of the projecting ends of the bars 13. When the bars are slid to the appropriate indicia, the slots 29 permit the release of bars 14. The Esquibel, et al. lock has a total of only 48 combinations possible with five bars 13.

It is a primary object of the present invention to ameliorate the problems noted in the prior art above and provide a low cost combination lock that is considerably more tamper-proof than prior art constructions while at the same time having a greater number of possible combinations.

In our parent application, U.S. Ser. No. 08/853,941, a low cost tamper resistant combination lock is provided that combines a high number of possible combinations with improved tamper resistance. That lock included a one piece molded plastic housing having a through bore that receives a one piece plastic plunger having a plurality of integral spherical obstructions. The housing has a plurality of transverse slots each receiving one of two identical blocking slides that snap between three distinct positions, one passing the spherical obstructions and two blocking the obstructions and plunger. Lock picking was minimized by integral flexible fingers in obstruction passing apertures in the slides that engage the spherical obstructions when the slides are in the plunger passing position to simulate the slide blocking positions as the lock picker tugs the plunger.

The housing had a plurality of rivet head shaped bottom projections that can pass through apertures in a flexible pistol case enabling the lock to be used to engage and lock the zipper tang of the case in its zipper closed position.

In the parent application, the first of the two blocking slides is rectangular in configuration and has a central through bore that has a diameter slightly larger than the plunger's spherical obstructions and side slots extending laterally from the central aperture that receive the small diameter portions of the plunger between the spherical obstructions when this slide is in its two blocking positions on either side of the central aperture. Both sides of this blocking slide have side recesses aligned with the ends of the slot that receive the spherical plunger projections when in the blocking positions providing a snap action movement of the blocking slide between its three positions when tension is applied to the plunger.

This snap action not only facilitates the use of the blocking slides but also improves tamper resistance because the lock picker feels the same snap action when moving from the blocking position to the pass position or from the pass position to one of the blocking positions.

To further enhance tamper resistance, a plurality of integral tabs or spring fingers were formed in the central passing aperture in the slides, and they engage the spherical obstructions when the slide is in the passing position. Thus, if the lock picker tugs on the plunger when the slide is in its passing position(but still blocked by other blocking slides), the spherical obstruction will hit the spring fingers causing that particular slide to shift slightly in the slot in a longitudinal direction the same as the slides do when in the blocking position. In this way the lock picker cannot distinguish between the slight shifting movement of the slide in the blocking position and the slides in the passing position when he tugs longitudinally on the plunger.

The second blocking slide was similar to the first except that the passing aperture is in the side position and the slot is a lateral slot extending from the aperture through the central position to the opposite side position. This slide has the same spherical receiving recesses as the first blocking slide formed on both surfaces. This second slide can be reversed in the housing slots to provide both left-hand and right-hand passing thereby increasing the possible combinations without any additional cost.

The slides had flexible fingers adjacent the passing position for the plunger that flex radially outwardly to permit the plunger obstructions to pass there-through. These slides are prevented from falling out of the lock body when the plunger is completely withdrawn by an integral leaf spring formed on the slides that engage one side of the housing slots. The lower side of the slides had three recesses that are selectively received in a projection or detent in the bottom of the slot to selectively hold the slide in one of its three positions.

SUMMARY OF THE PRESENT INVENTION

In accordance with the present invention, an improved low cost tamper resistant combination lock is provided with large planar easy to shift blocking slides with a spring finger on each slide that fools the lock picker into believing all three positions of the slides are blocking positions. The slides block or pass spaced spheroidal obstructions on a plunger that has an end projecting from the lock that defines the lock shackle.

Each slide has a central slot with three adjacent recesses that define the three indexible positions for each slide. Two of these positions are blocking positions for the spheroidal obstructions on the plunger, and one is a passing position. One side of the slot is defined by a cantilevered leg adjacent a second slot that permits the leg to spring outwardly and pass the spheroidal obstructions through the passing one of the three positions. When all the slides are not in the pass position, the slides that are in the pass position fool the lock picker tugging on the plunger because the pass position of the slot, absent springing movement of this leg, causes the lock picker to believe that particular slide is in a blocking position.

The slides are also provided with a small pointed projection on one side that snaps into one of six grooves in its housing slot to prevent the slides from dropping out of the housing during normal operation. This pointed projection also has spring action because it is formed on the slides immediately adjacent the housing slots that provide the spring action for the spring leg, a significant design expedient. Also, the six grooves are divided three on each side of each slot so that the projection will mate with three grooves regardless of the rotational orientation of the slide in the slot. In this regard, it should be remembered that the user can change the program combination of the lock by removing the slides from one slot and positioning them in another and also by rotating the slides 180 degrees end to end.

A further feature of the present invention is a bifurcated clip in the housing that permits opening movement of the plunger and its associated shackle but prevents complete removal of the plunger from the housing. Toward this end, the clip is reciprocably mounted and receives the upper end of the plunger between its two legs. The clip has one position in which the plunger spheroidal obstructions may pass, and a second position which closely surrounds the diameter of the plunger between these spheroidal obstructions which blocks extensive outward movement of the plunger and shackle from the housing. In this position, which is the normal position, the plunger itself keeps the clip in its blocking position. This clip is shifted to its release position by inserting a paper clip through a small hole in the housing.

This programmable combination lock is also in the form of a padlock in which the "U" shaped shackle of the padlock is co-planar with the slides to provide a more compact housing and one that can be utilized in a significantly greater number of special positions.

Other objects and advantages of the present invention will appear more clearly from the following detailed description.

BRIEF DESCRIPTION OF THE PREFERRED EMBODIMENT

Figure 3:
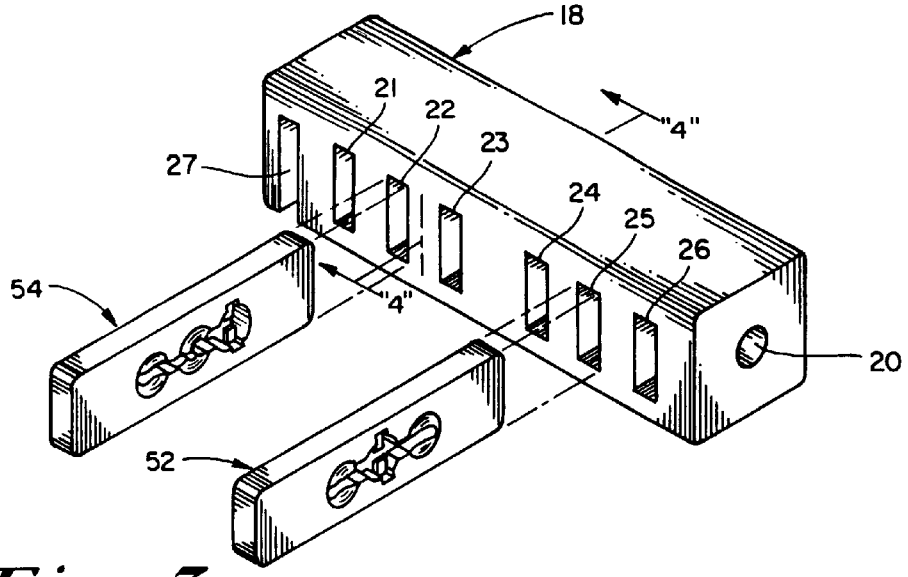
Figure 4:
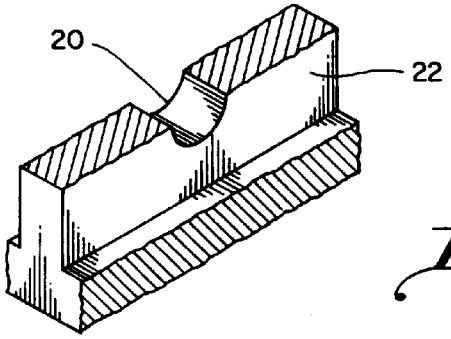
Figure 5:
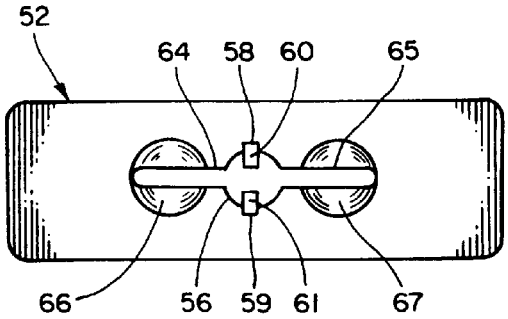
Figure 6:
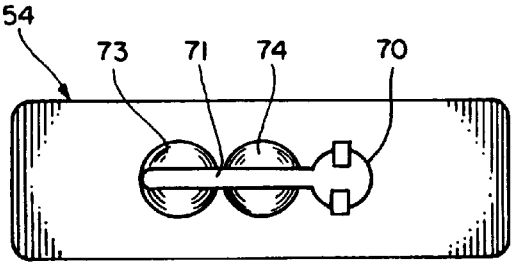
Figure 7:
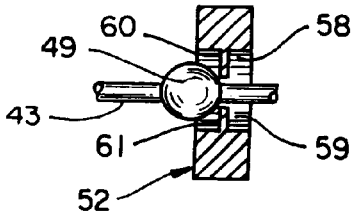
Figure 8:
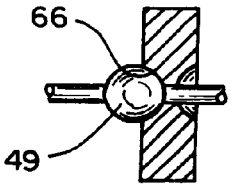
Figure 9:
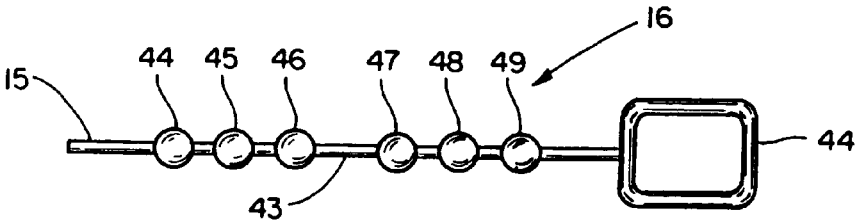
Figure 10:
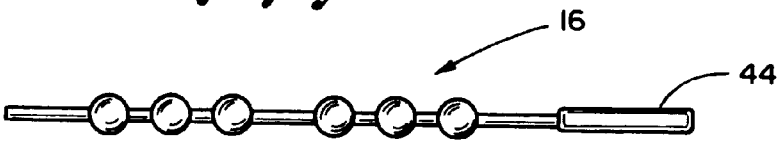
Figure 11:
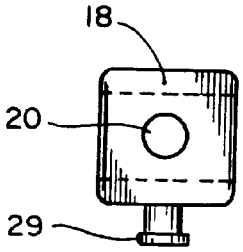
Figure 12:
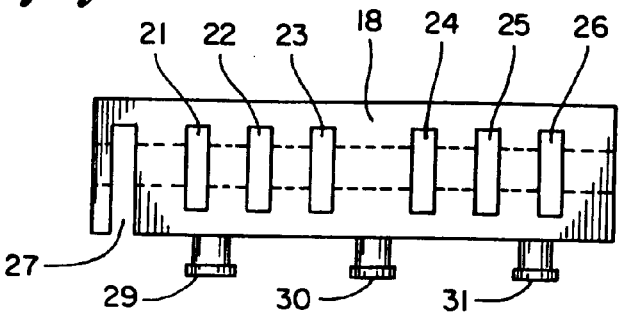
Figure 13:
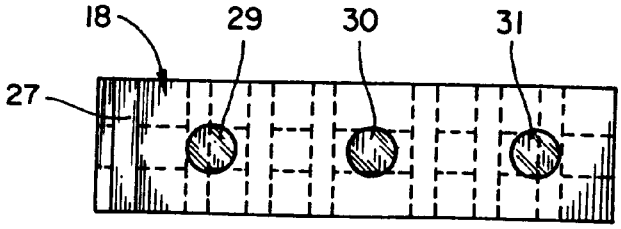
Figure 19:
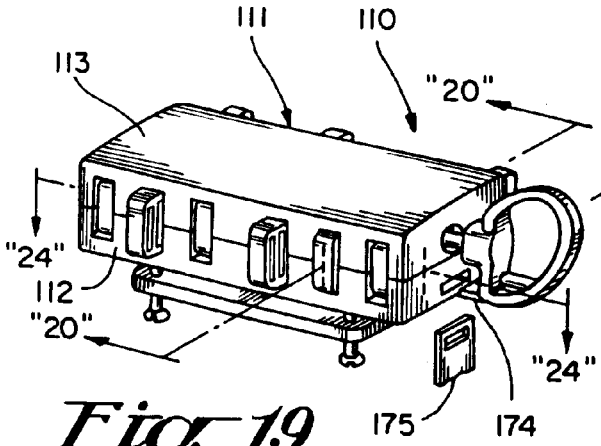
Figure 22:
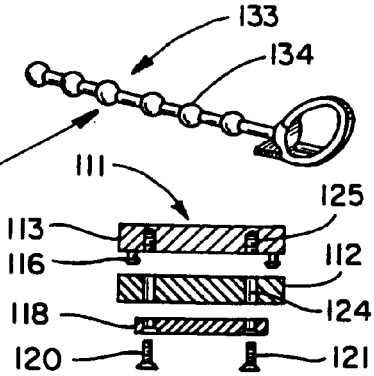
Figure 20:
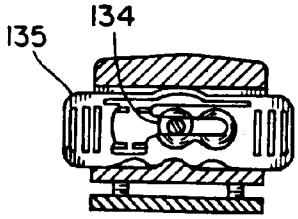
Figure 21:
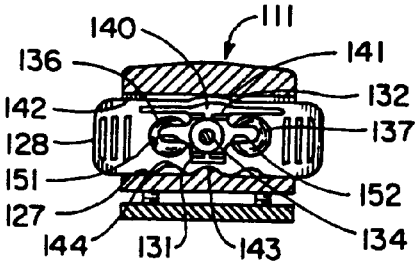
Figure 23:
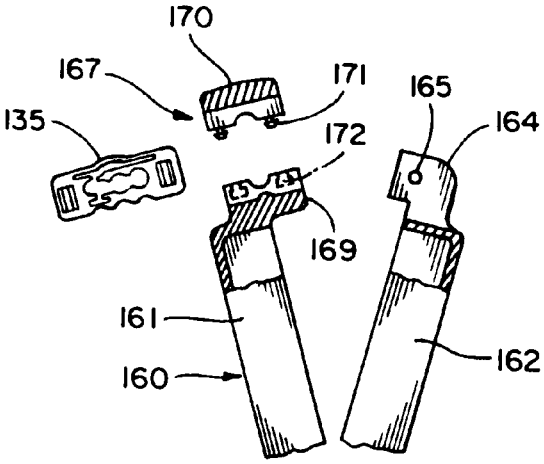
Figure 24:
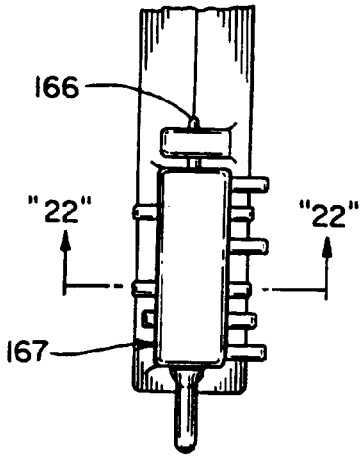

FIG. 3 an exploded perspective illustrating the one piece lock housing with one of each of the two standard blocking slides;

FIG. 4 is a fragmentary section of the housing taken generally along line 4—4 of FIG. 3;

FIG. 5 is a side view of one of the standard blocking slides;

FIG. 6 a side view of the other standard blocking slide;

FIG. 7 is a cross section through one of the blocking slides taken through the passing aperture showing the spring finger positions;

FIG. 8 is a cross section through the blocking slide in one of the blocking positions;

FIG. 9 is a sub-assembly view of the locking plunger;

FIG. 10 is an orthogonally rotated view of the locking plunger illustrated in FIG. 9;

FIG. 11 is an end view of the lock housing;

FIG. 12 is a side view of the lock housing;

FIG. 13 is a bottom view of the lock housing;

FIG. 14 is an end view of the L-shaped housing slide connector;

FIG. 15 is a side view of the connector illustrated in FIG. 14;

FIG. 16 is a bottom view of the connector illustrated in FIGS. 14 and 15;

FIG. 17 is a longitudinal section of the present tamper resistant lock with all six blocking slides shown in various positions;

FIG. 18 is an alternative form of the present tamper resistant lock shown and exemplified in a padlock type lock;

FIG. 19 is a perspective view of another embodiment of the present tamper resistant lock assembly;

FIG. 20 is a cross-section taken generally along line 20—20 of FIG. 19 with a side pass slide therein;

FIG. 21 is a cross-section generally similar to FIG. 20 with a central pass slide therein;

FIG. 22 is an exploded view of the tamper resistant lock assembly illustrated in FIG. 19;

FIG. 23 is a partly fragmented section of a clamshell hard plastic case with the present tamper resistant lock assembly formed in part integrally therewith, and;

FIG. 24 is a top view of the tamper resistant lock assembly shown in FIG. 23.

Figure 25:
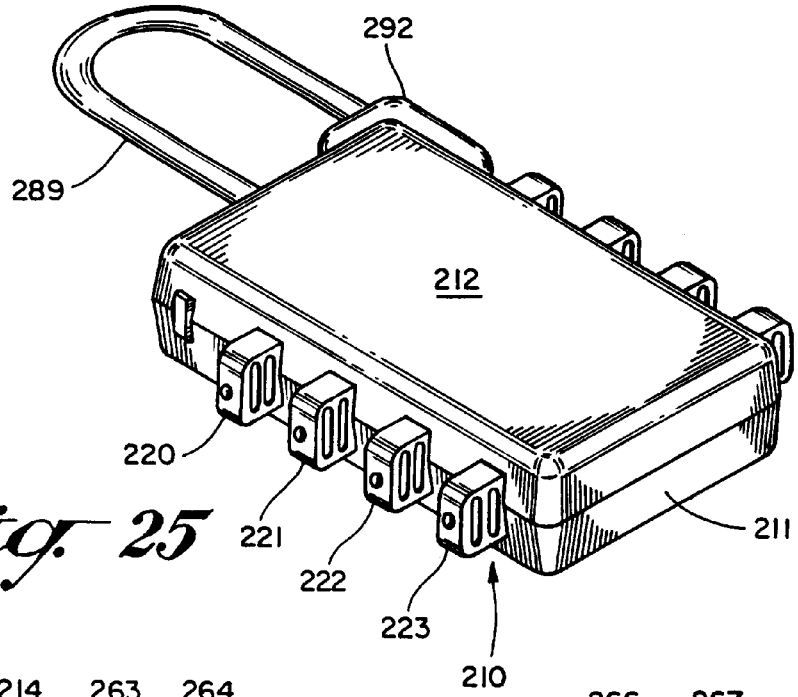
Figure 26:
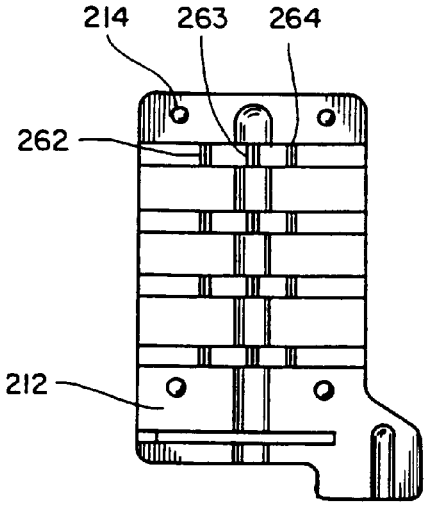
Figure 27:
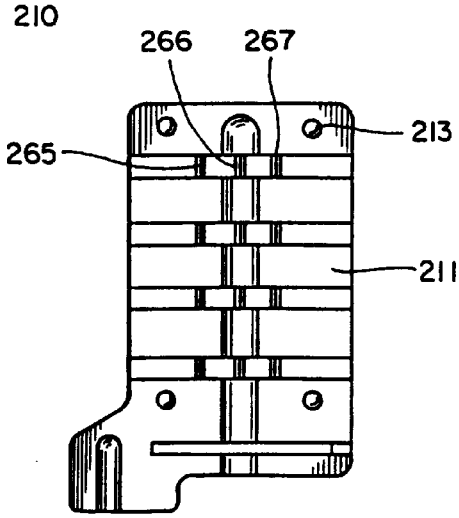
Figure 28:
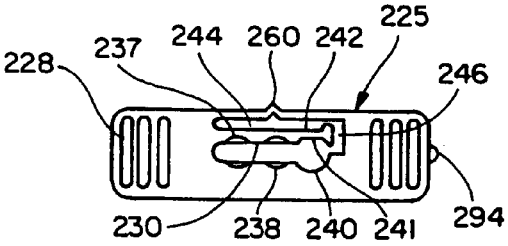
Figure 29:
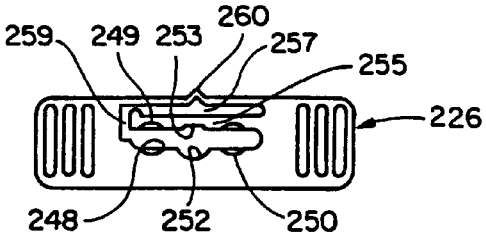
Figures 30, 31, 32, 33:
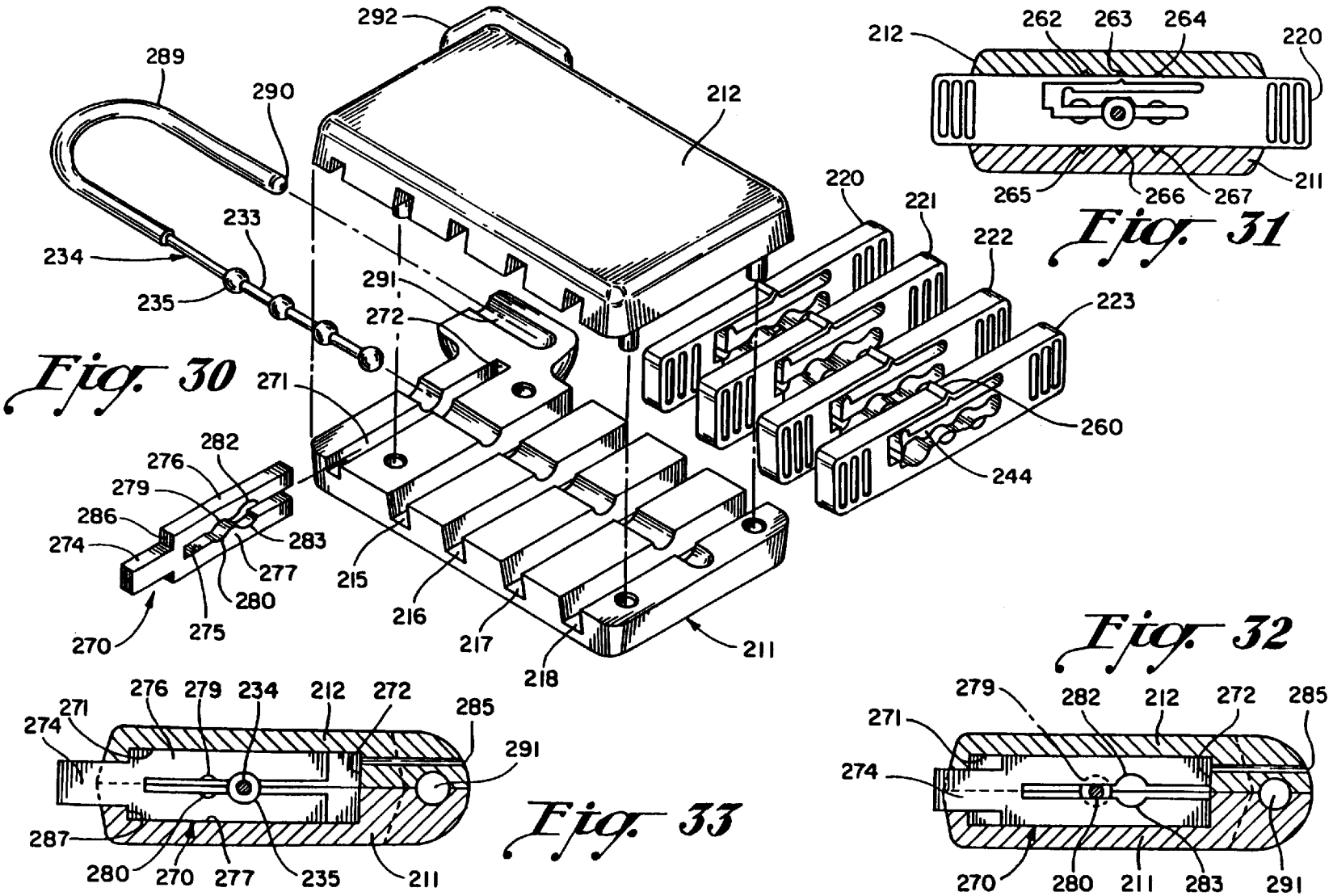

FIG. 25 is a perspective view of another embodiment of the present lock embodied in a padlock-type lock;

FIG. 26 is a sub-assembly view of one-half of the housing illustrated in FIG. 25;

FIG. 27 is a sub-assembly view of the mirror image half of the housing illustrated in FIG. 26;

FIG. 28 is a sub-assembly view of one slide with a right-hand pass position;

FIG. 29 is a sub-assembly view of a slide with a central passing position;

FIG. 30 is an exploded view of the padlock-type lock illustrated in FIG. 25;

FIG. 31 is a cross-section through one of the slides taken generally along line 31'31 of FIG. 25;

FIG. 32 is a cross-section taken generally along line 32—32 of FIG. 25 with the spring clip illustrated in its blocking position, and;

FIG. 33 is a cross-section similar to FIG. 32 with the clip illustrated in its release position.

DETAILED DESCRIPTION OF THE PREFERRED EMBODIMENT

The following description of FIGS. 1 to 24 is largely identical to the description found in our U.S. Ser. No. 08/853,941.

Figure 1:
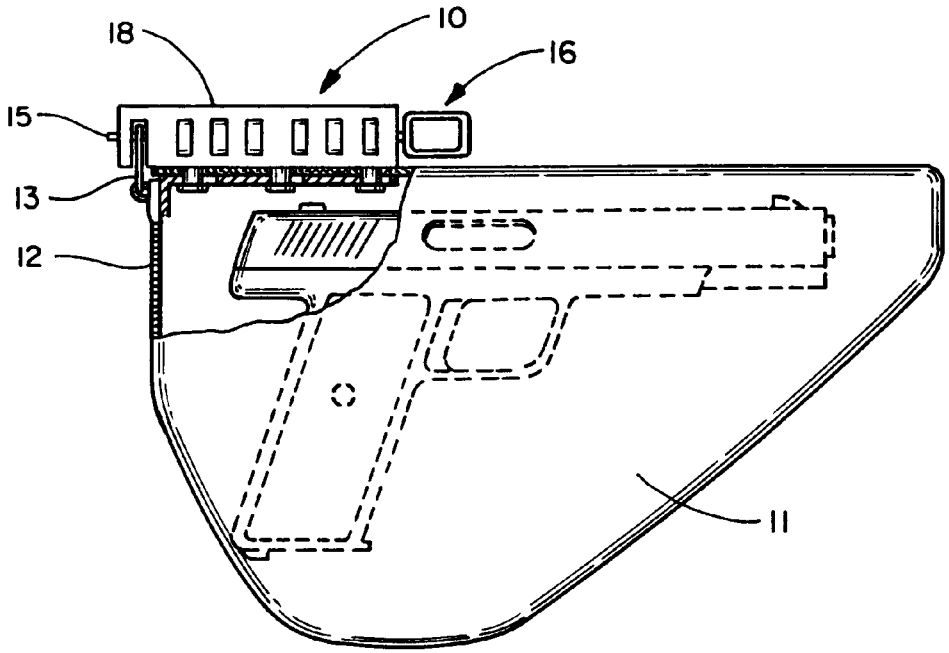
FIG. 1 is a side view of a flexible pistol case with the present tamper resistant combination lock fastened to its upper surface holding its zipper tang in a locked position with part of the fabric broken away near the lock mounting.
Figure 2:
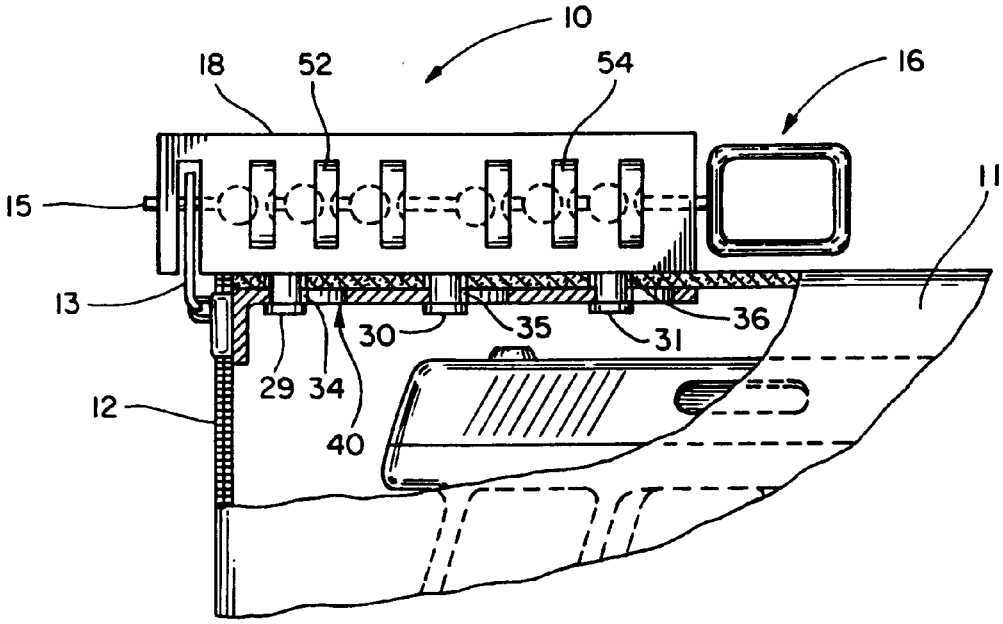
FIG. 2 is an enlarged fragmentary view of FIG. 1 showing the present tamper resistant combination lock and illustrating its manner of connection to the pistol case.

Referring to the drawings and particularly FIGS. 1 and 2, the present tamper resistant combination lock assembly 10 is illustrated attached to a flexible pistol case 11 having a peripheral zipper 12 and a pivotal zipper tang 13 having a conventional aperture there-through held in a locked position by distal end 15 of a locking plunger 16 forming part of the combination lock 10.

As seen in FIGS. 3, 4, and 11 to 13, the lock housing 18 is seen to be generally rectangular in configuration and may be constructed of a one piece plastic molding. A central bore 20 extends longitudinally through the housing and it is intersected by six blocking slide receiving transverse slots 21, 22, 23, 24,25 and 26. Note the configuration of the slots and bore shown in fragmentary form in FIG. 4. An additional end slot 27 is provided for receiving zipper tang 13.

As seen in FIGS. 11 and 12, the housing has three integral headed projections 29, 30, 31 extending downwardly therefrom that are designed to pass through apertures 34, 35 and 36 in the top wall of the pistol case 11. A key-hole type L-shaped connector 40 illustrated clearly in FIGS. 14, 15 and 16 has three key-hole type apertures 41 that receive the headed projections 29, 30 and 31 to lock the housing 18 and the lock 10 to the pistol case 11 in its appropriate position.

As seen in FIGS. 9 and 10, plunger 16, which can be easily constructed of a one piece plastic molding, includes a rod portion 43 having a finger loop 44 at one end and six integral spherical obstructions 44, 45, 46, 47, 48 and 49.

Two standard blocking slides 52 and 54 are illustrated respectively in FIGS. 5 and 6(as well as FIG. 3). It should be understood that of the six slides in the exemplary embodiment illustrated, three take the form of slide 52 and three take the form of slide 54.

It should be understood as seen in FIGS. 3, 5 and 6, that the slides 52 and 54 are rectangular in configuration and identically configured on both sides of each so that the slides 52, 54 are reversible in slots 21 to 26.

Each of the slides is a one piece rectangular plastic molding, and slide 52 includes a central through aperture 56 having a diameter slightly larger than spherical obstructions 44 to 49. Aperture 56 has upper and lower key-type slots 58 and 59 that have molded therein integral spring fingers 60 and 61 shown also in FIG. 7. The spherical projection 49 in FIG. 7 is illustrated in the lock position of the plunger, and in this position the spring fingers 60 and 61 engage one side of the obstruction 49. As a would-be lock picker pulls outwardly on plunger loop 44, obstruction 49, because of its engagement with spring fingers 60 and 61, shifts the slide very slightly laterally in its slot the same way the obstruction would shift the slide when in its blocking position illustrated in FIG. 8. In this way, regardless of whether the slide is in its blocking position or in its passing position, when the plunger is pulled axially, each of the slides will shift in their respective slots making it impossible for the lock picker to distinguish between slides in the locking position and slides in the blocking position.

However, fingers 60 and 61 are sufficiently flexible so they fold down in their adjacent recesses when plunger 16 is pulled with all the slides in the obstruction passing position, permitting the distal end 15 of the plunger to release tang 13.

Returning to FIG. 5, slide 52 has a pair of transverse slots 64 and 65 having a height somewhat greater than the rod portions 43 of the plunger that receive the rod portion in the two blocking positions of slide 52. The slide 52 has side recesses 66 and 67 at the ends of the slots(on both sides of the slides) that receive the spherical plunger projections when the slide is in its blocking position that provide the snap action movement of the slides when force is applied to the plunger(see FIGS. 8 and 17 for exemplary illustrations of the spherical projections when in the blocking recesses).

The blocking slide 54 has the same outer geometry as the slide 52 but rather than a central aperture has a side aperture 70 that passes projections 44 to 49 and a lateral slot 71 that passes plunger portion 43 and extends through the central position of the slide and the other side position. Recesses 73 and 74 are provided on both sides of the slide aligned with the two blocking positions of the slide and are identical in geometry to recesses 66 and 67 in slide 52.

Because both sides of slide 54 are identical, this slide can be reversed in the slots 21 to 26 to effect either right side blocking or left side blocking as desired thereby increasing the possible combinations of the lock without requiring the tooling for a third slide.

As seen in FIG. 17, plunger 44 is in its locked position and in this position the spherical projections 44 to 49 are either partly in one of the passing apertures 56 in slides 52 or 70 in slides 54, or in one of the blocking recesses 66, 67, 73, 74. The position of the loop 44 close to housing 18 holds the spherical projections 44 to 49 in either the blocking recesses or through apertures in the slides. However, there is still a small amount of play there-between.

In use, and in reference particularly to FIG. 17, assume that each of the blocking sides 52*a*, 52*b*, 52*c*, 54*a*, 54*b*, and 54*c* are in their plunger passing positions and that plunger 16 is partly withdrawn with its distal end 15 short of end slot 27. Gun case zipper 12 is then closed and its tang 13 positioned as shown, then plunger 44 is shifted to the left impaling the aperture in the zipper tang and moving the plunger to its locking position illustrated in FIG. 17.

Slides 52 and 54 are then all shifted away from the passing positions to one of the two blocking positions of each. Unlocking is, of course, effected by shifting each of the slides from one's memory or notes to its passing position. Because each of the blocking slides has only three positions and these positions are distinct, it is relatively easy to memorize the lock combination and also relatively easy for the lock user to unlock the lock from memory simply by "feeling" the position of the slides even in the dark.

The lock combination can be changed by either switching one or more slides 52 with one or more slides 54 or by rotating one or more slides 54 180 degrees in its slot as noted above.

FIG. 18 illustrates an alternative form of the present invention and is exemplified as a combination padlock, and is seen to include a rectangular padlock housing 80 having a main bore 82 there-through and a secondary bore 83 extending partly there-through that receives a distal end 84 of a U-shaped portion 85 of plunger 86. The housing 81 has a plurality of transverse slots 87 there-through that receive a plurality of blocking slides 89 that effect selective blocking of spherical obstructions 90 formed on the plunger 86.

The portion of the plunger 86 slidable in main passage 82 is identical to the corresponding portion of plunger 16 in the FIGS. 1 to 17 embodiment and blocking slides 89 are identical to blocking slides 52 and 54 also illustrated with respect to the FIG. 17 embodiment. The plunger 86 and U-shaped portion 85 are rotatable in housing main passage 82 to effect the desired swiveling motion in a padlock and, of course, the symmetrical shape of the plunger portion in bore 82 and the spheroidal configuration of obstructions 90 conveniently accommodate the desired pivotal, as well as reciprocal, motion of U-shaped plunger portion 85 as distal end 84 moves in and out of secondary passage 83 and swivels toward and away from the lock body 81.

Referring to FIGS. 19 to 22, which illustrate an alternative embodiment 110 of the present tamper resistant lock assembly, it should be understood that this lock operates in substantially the same manner as the lock illustrated in FIGS. 1 to 17, as well as the lock illustrated in FIG. 18, in the drawings. Lock assembly 110 includes a block-like housing 111 consisting of a lower housing half 112 and an upper housing half 113, that are locked together by inter-engaging projections 116 that in upper housing half 111 lock into recesses not shown in lower housing half 112.

The lock 110 is held in position on its associated case by a backing plate 118 that fits within the case, held in position by a plurality of fasteners 120 and 121 that extend through lower housing half apertures 124 and are threaded into apertures 125 in the upper housing half 113 to not only lock the entire lock assembly in position but also to lock the housing halves together in a tamper resistant fashion because fasteners 120 and 121 are inside the lock case.

As seen in FIG. 21, which is an enlarged cross-section through FIG. 19, the housing 111 has through slots 127 that correspond with the slots in the FIGS. 1 to 17 embodiment, and each receive a central pass slide member 128, which function in a similar way to the slides shown in the FIGS. 1 to 17 embodiments. Slide 128 has a central aperture 131 having a diameter greater than the spheroidal blocking obstructions 134 on the plunger 133 to permit the plunger to be withdrawn when the slide 128 is in its central passing position. As in the FIGS. 1 to 17 embodiment, the passing aperture 131 is positioned in second slides 135 shown in FIG. 20, in one of the side apertures as opposed to the central aperture. The slide 128 has four flexible fingers 132 that are positioned on a diameter less than the diameter of spheroidal obstructions 134 to interfere with the obstructions 134 and function in the same way as fingers 60 and 61 illustrated in FIG. 5 to effect shifting of the slides 128 and 135 as the lock picker tugs on the plunger 133 to simulate a blocking position of the slides 128 and 135 when in fact they are in the passing position. Fingers 132 move radially with respect to the axis of the plunger 133 as opposed to the general axial bending movement of the fingers 60 and 61 in the FIG. 5 embodiment.

The two side positions of the slides 128 are defined by spheroidal recesses 136 and 137 that partly receive the end of the projections 134 to provide the snap action movement of the slides 128 when tension is applied to the plunger 133 in a manner similar to the FIGS. 1 to 17 embodiment. The depth of the recesses 136 and 137 is selected so that the plunger obstructions 134 engage the bottom of the recesses 136 and 137 with the same axial movement of the plunger 133 as when the plunger obstructions 134 engage the fingers 132.

The aperture 131 in FIG. 21 is contiguous with side slots 151 and 152 and they permit the slides to be shifted to their side positions aligning one of the spheroidal recesses 136 and 137 with the axis of plunger 133.

As with the FIGS. 1 to 17 embodiment, the snap action movement of the slide 128 to its three positions is achieved with tension being applied to the plunger 133 engaging the obstructions 134 in the recesses 136 and 137 or against the fingers 132, and as the slide 128 is shifted with that tension being applied, the user or lock picker can feel the snap action movement of the slides 128. The same is true of the slides 135.

According to the FIGS. 19 to 21 embodiment, means are provided to prevent the slides 128 and 135 from falling out of the housing 111 when the plunger 133 is completely withdrawn. Toward this end, a slot 140 is provided in the slides 128 and 135 that defines an upwardly arching integral leaf spring 141 that engages the upper surface 142 of slot 127 to continuously bias slides 128 and 135 downwardly toward the bottom of the slots 127. The bottom of each of the slots 127 has an axial projection 143 that selectively engages one of three recesses 144 to hold the slides in one of its three capable positions.

In FIGS. 23 and 24, a clamshell-type rigid plastic case 160 is illustrated having case halves 161 and 162 that close together from the position shown in FIG. 23 to the top view closed position illustrated in FIG. 24. Case half 162 has an integral tang 164 with an aperture 165 therein, that receives a plunger 166 on lock assembly 167 that locks the case halves 161 and 162 together.

Lock assembly 167 consists of a lower housing half 169 that mates with an upper housing half 170 connected together by interlocking male and female projections 171 and 172. Housing halves 169 and 170 can also be connected together by tamper proof fasteners that extend from inside the case 160 in a similar fashion to fasteners 120 and 121 illustrated in FIG. 22. An important aspect of the lock 167 is that the lower housing half 169 is molded integrally with case half 161 providing not only an extremely low cost lock assembly, but one that is cosmetically attractive in the sense that it appears more integrated with the case 160.

Referring to FIGS. 25 to 33, which illustrate an alternative embodiment 210 of the present tamper resistant lock assembly embodied in a padlock-type lock, it should be understood that this lock operates in substantially the same manner as the locks illustrated in FIGS. 1 through 24 in the drawings.

Referring to the drawings and particularly FIGS. 25 to 33, lock assembly 210 is seen to include mirror image mating housing halves 211 and 212 interfitted and aligned together by pins 213, which are received in holes 214 in housing half 212. Four rectangular slots 215, 216, 217, and 218 are formed in the housing by aligned grooves in the housing halves 211 and 212. There are four injection molded plastic slides 220, 221, 222 and 223 slidably received respectively in slots 215, 216, 217 and 218. Slides 220, 221, 222 and 223 take the form of either slide 225 in FIG. 28 or slide 226 illustrated in FIG. 29. The FIG. 28 slide is a side passing slide, and the FIG. 29 slide is a central passing slide. Each of the slides 225 and 226 is provided with a plurality of shallow elongated recesses 228 on each end on both sides to facilitate gripping the slides when pulled by the fingers. Each of slides 225 and 226 has three indexible positions, two of these are blocking positions and one a passing position. Slide 225, the side passing slide, has an elongated central slot 230 having a width slightly greater than the diameter 233 of plunger 234 between the spheroidal obstructions 235. When the plunger extends through the slot 230, the slot defines the extreme positions of the slides in both directions, limited by the plunger diameter 233. Spheroidal recesses 237 and 238 receive a small part of the spheroidal projections 235 to provide an indexing movement as the slide is snapped into one of its blocking positions defined by recesses 237 and 238. The passing position in slide 225 is provided by semi-circular recesses 240 and 241. Recess 240 is formed at a diameter sufficient to permit passage of spheroidal projections 255, and so is recess 241, except recess 241 has a flat bottom that interferes with the obstructions 235. In this way, if the slide 225 is in its passing position defined by recesses 240 and 241, and the lock picker tugs on the plunger 234, slide 225 will shift slightly in its slot causing the lock picker to believe the slide is in a blocking position rather than a passing position.

If, however, the authorized user has all of the slides 220, 221, 222 and 223 in their pass positions, a cantilevered leg 242 springs radially outwardly permitting the flat bottom recess 241 to move out of the way of the obstructions 235 and permit passage of plunger 234.

The spring action of leg 242 is provided by a slot 244 parallel and adjacent the slot 230. Slots 230 and 244 are interconnected by a transverse third slot 246 and together define the cantilevered configuration of leg 242.

Referring to FIG. 29, slide 226 is similar to slide 225 except it is a center pass slide. Slide 226 includes a central slot 248 having slide spheroidal recesses 249 and 250 that define the indexible blocking positions for these slides, and central semi-annular recesses 252 and 253 that form the pass position. Recess 253 has a flat bottom similar to recess 241 that engages the plunger and causes the lock picker to be fooled into thinking the plunger is in a blocking rather than passing position. Similar to leg 242, slot 248 is defined by a flexible leg 255 that permits the recess 253 to open and permit the obstructions 235 to pass therethrough when all of the slides 220, 221, 222, and 223 are in their passing positions. Leg 255 is cantilevered to achieve this spring action, and this is created by slot 257 and closely adjacent parallel slot 248 and a third interconnecting slot 259.

Each of the slides 225 and 226 is provided with a knife edge projection 260 on one side thereof adjacent slot 244 (slide 225) or slot 257(slide 226). The location of the knife edge projection 260 adjacent the slots 244, 257 gives a spring action to the knife edge projection 260 and enables it to snap in and snap out of recesses in the housing as the slides are indexed between its three positions.

As seen in FIGS. 26, 27 and 33, each of the slots 215, 216, 217 and 218 has three grooves 262, 263, and 264 in one side and identical three grooves 265, 266, and 267 in its other side. In this way regardless of which rotational position the slides 225 and 226 are inserted into the slots, the knife edge projections will have a set of three grooves, either grooves 262, 263 and 264, or grooves 265, 266, and 267, into which it may snap. The snap action of the knife edge projection 260 into the grooves 262 to 267 prevents the slides from falling out of the housing 211, 212 when the plunger 234 is removed from the housing.

As seen in FIGS. 30, 31 and 32, a plastic clip 270 is provided for preventing the plunger 234 from being completely removed from the housing 211, 212 during normal opening movement, but which permits the plunger to be removed from the housing when the owner desires to either repair the lock, or change the lock combination. In this regard, it should be understood that it is an important aspect of the present invention that the lock be easily user programmable by removal of the slides 220, 221, 222 and 223, and either shifting positions of the slides and/or by rotating them end to end to change the lock combination.

Clip 270 is slidable in housing slot 271 that is dead-ended at 272 to block inward movement of the clip 270 at its blocking position. Clip 270 is planar and has a reduced plunger portion 274 that projects slightly from the housing as seen in FIGS. 25 and 32 when the clip is in its blocking position shown in FIG. 32 with the inner end of the clip in engagement with the slot end 272. The clip 270 is bifurcated by a slot 275 forming legs 276 and 277. The legs 276, 277 have mating semi-annular recesses 279 and 280 formed at a diameter slightly greater than plunger portion 233, and these surfaces define the blocking position of the clip 270. Also, when in the blocking position, the upper plunger portion 233, because it snaps into the recesses 279 , and 280, holds the clip in its blocking position shown in FIG. 32. A second pair of semi-annular recesses 282 and 283 define the passing position and these surfaces are formed at a diameter slightly greater than the projections 235 to permit passage of the plunger obstructions when the clip is in its passing position illustrated in FIG. 33.

Movement of clip 270 to its blocking position is achieved by pushing inwardly on clip operator 274, and movement of the clip from its blocking position to its release position is achieved by inserting a straightened paper clip through small hole 285 which communicates with slot 271 through end surface 272, engaging the end of the leg 276 and shifting the clip to its outermost position where shoulders 286 on the clip engage shoulders 287 at the outer end of the slot 271. This position defines the pass position of the clip 270 shown in FIG. 33.

As discussed above, the lock 210 is a padlock-type lock and toward this end the plunger 234 is formed with a "U" shaped shackle 289 having a distal end 290 insertable into a hole 291 in the housing 211, 212. Hole 291 is formed in a boss 292 that projects outwardly from the upper end of the housing 211, 212. Boss 292, and the location of the shackle hole 291 in a plane that also contains slots 215, 216, 217 and 218 reduces the size of the present combination lock and also has an extended range of motion in all orthogonal directions when in use; that is, it can achieve more difficult locking positions.

A further feature of the present invention is the molding of dimples 294 on the end pass slides 225. Dimples 290 are formed only on one end of the side passing slides; that is, the end of the slide 225 closest to the pass surfaces 240 and 241. The slides 226 have no such dimples. The dimples enable the new buyer to experiment with different lock combinations without risk of forgetting or misplacing the combination. That is, the new owner knows that when a dimple slide is pressed all the way in from the dimple direction, it is in its passing position. He also knows that the slides with no dimples 294, which of course would be slides 226, are in their passing position when centered in the housing. After the user becomes proficient with lock combination changes, he is instructed to scuff off the dimples 294 and to similarly scuff both ends of all the slides so that the lock picker cannot tell one slide or one end of any slide from another.

A further feature of the present invention is that slot 230 in slide 225 and slot 248 in slide 226 are exactly the same length so that the lock picker cannot distinguish one slide from another by pushing the slides to their extreme positions. Also, both slots 230 and 248 are centered in the slides so both slides have an equal range of movement to the right and left of their center position. In this regard, note the slot 230 extends substantially to the left of the center of recess 237 in FIG. 28 to equal the right extend of the slot defined by larger recesses 240 and 241. Slot 248 also extends beyond the center of recesses 249 and 250 in FIG. 29 an equal length.

We claim:

1. A combination lock, comprising: a housing, a plurality of generally parallel slots in the housing, a plunger bore extending in the housing transverse to and interconnecting the slots, a plunger slidably received in the housing plunger bore having a plurality of obstructions thereon, a plurality of slides in the housing slots each having at least one plunger blocking position and one plunger pass position, first slot means in the slides defining at least in part both the plunger blocking position and the plunger pass position, said slot means in the plunger pass position at least partly blocking the plunger obstructions to simulate the plunger blocking position, and means to pass the plunger obstructions when all the slides are in the plunger pass position including a second slot means in the slides adjacent the first slot means permitting a portion of the slides between the first and second slot means to flex outwardly in a direction transverse to the housing bore and permit the plunger obstructions to pass through the slides.

2. A combination lock as defined in claim 1, wherein the first slot means includes a spheroidal recess at the plunger blocking position in the slides whereby the slides index from the plunger blocking position to the plunger pass position by engagement with the plunger obstructions.

3. A combination lock as defined in claim 1, wherein the first and second slot means in the slides are parallel and closely adjacent one another, said first and second slot means being connected at one end by a third slot means whereby the flexing portion of the slides is cantilevered.

4. A combination lock as defined in claim 1, including means to hold the slides in the housing slot including an integral projection on said slides engageable selectively with one of a plurality of grooves in the housing slots.

5. A combination lock as defined in claim 4, wherein the projection is spring biased by being positioned adjacent the second slot means.

6. A combination lock, comprising: a housing, a plurality of generally parallel slots in the housing, a plunger bore extending in the housing transverse to and interconnecting the slots, a plunger slidably received in the housing plunger bore having a plurality of obstructions thereon, a plurality of slides in the housing slots each having at least one plunger blocking position and one plunger pass position, first slot means in the slides defining at least in part both the plunger blocking position and the plunger pass position, said slot means in the plunger pass position at least partly blocking the plunger obstructions to simulate the plunger blocking position, and means to pass the plunger obstructions when all the slides are in the plunger pass position including a second slot means in the slides adjacent the first slot means permitting a portion of the slides between the first and second slot means to flex outwardly in a direction transverse to the housing bore and permit the plunger obstructions to pass through the slides, said slides being planar and having a length substantially greater than the housing slots whereby the slides project from one or both sides of the housing, said first and second slot means in the slides being parallel and closely adjacent one another, said first and second slot means being connected at one end by a third slot means whereby the flexing portion of the slides is cantilevered.

7. A combination lock, comprising: a housing, a plurality of generally parallel slots in the housing, a plunger bore extending in the housing transverse to and interconnecting the slots, a plunger slidably received in the housing plunger bore having a plurality of obstructions thereon, a plurality of elongated slides each having an axis in the direction of elongation in the housing slots each having at least one plunger blocking position and one plunger pass position, slot means in the slides defining at least in part both the plunger blocking position and the plunger pass position, means to prevent the slides from being easily removed from the housing slots including an integral projection on one side of the slides, a plurality of grooves on one side of the housing slots adapted to releasably receive the slide projection, and a plurality of grooves on the other side of the housing slots adapted to releasably receive the slide projection whereby the slide projection will be engaged in one of the plurality of grooves regardless of the rotational position of the slides about their axis in the housing slots.

8. A combination lock, comprising: a housing, a plurality of generally parallel slots in the housing, a plunger bore extending in the housing transverse to and interconnecting the slots, a plunger slidably received in the housing plunger bore having a plurality of obstructions thereon, a plurality of elongated slides each having an axis in the direction of elongation in the housing slots each having at least one plunger blocking position and one plunger pass position, slot means in the slides defining at least in part both the plunger blocking position and the plunger pass position, means to prevent the slides from being easily removed from the housing slots including an integral projection on one side of the slides, a plurality of grooves on one side of the housing slots adapted to releasably receive the slide projection, and a plurality of grooves on the other side of the housing slots adapted to releasably receive the slide projection whereby the slide projection will be engaged in one of the plurality of grooves regardless of the rotational position of the slides about their axis in the housing slots, said slot means in the plunger pass position at least partly blocking the plunger obstructions to simulate the plunger blocking position, and means to pass the plunger obstructions when all the slides are in the plunger pass position including a second slot means in the slides adjacent the first slot means permitting a portion of the slides between the first and second slot means to flex outwardly in a direction transverse to the housing bore and permit the plunger obstructions to pass through the slides, said projection being spring biased by being positioned adjacent said second slot means in the slides.

9. A combination lock as defined in claim 8, the first slot means including a spheroidal recess at the plunger blocking position in the slides whereby the slides index from the plunger blocking position to the plunger pass position by engagement with the plunger obstructions.

10. A combination lock, comprising: a housing, a plurality of generally parallel slots in the housing, a plunger bore extending in the housing transverse to and interconnecting the slots, a plunger slidably received in the housing plunger bore having a plurality of obstructions thereon, a plurality of slides in the housing slots each having at least one plunger blocking position and one plunger pass position, first slot means in the slides defining at least in part both the plunger blocking position and the plunger pass position, means for preventing complete removal of the plunger during normal opening movement including clip means slidably mounted in the housing movable from a first position passing the plunger obstructions to a second position blocking one of said plunger obstructions.

11. A combination lock as defined in claim 10, including a clip slot in the housing for receiving the clip means, said clip slot being substantially closed at one end to block inward movement of the clip means and thereby define the second blocking position of the clip means.

12. A combination lock as defined in claim 11, including a small hole in the housing for receiving a small diameter tool to engage the end of the clip means at the closed end of the clip slot to push the clip means to its first passing position.

13. A combination lock as defined in claim 12, said clip means being bifurcated defining first and second leg positions, said second position including adjacent recesses in the leg portions together forming an opening about the size of the plunger between the obstructions so the plunger holds the clip means in its second position.

14. A combination lock as defined in claim 12, said clip means being bifurcated forming first and second leg positions, said first portion being defined by adjacent recesses in the leg portions forming an opening between the leg portions about the size of the plunger obstructions to pass the plunger obstructions.

15. A combination lock, comprising: a housing, a plurality of generally parallel slots in the housing, a plunger bore extending in the housing transverse to and interconnecting the slots, a plunger slidably received in the housing plunger bore having a plurality of obstructions thereon, a plurality of slides in the housing slots each having at least one plunger blocking position and one plunger pass position, first slot means in the slides defining at least in part both the plunger blocking position and the plunger pass position, means for preventing complete removal of the plunger during normal opening movement including clip means slidably mounted in the housing movable from a first position passing the plunger obstructions to a second position blocking one of said plunger obstructions, said slot means in the plunger pass position at least partly blocking the plunger obstructions to simulate the plunger pass position, and means to pass the plunger obstructions when all the slides are in the plunger pass position including a second slot means in the slides adjacent the first slot means permitting a portion of the slides between the first and second slot means to flex outwardly in a direction transverse to the housing bore and permit the plunger obstructions to pass through the slides.

16. A combination lock, comprising: a housing, a plurality of generally parallel slots in the housing, a plunger bore extending in the housing transverse to and interconnecting the slots, a plunger slidably received in the housing plunger bore having a plurality of obstructions thereon, a plurality of slides in the housing slots each having at least one plunger blocking position and one plunger pass position, first slot means in the slides defining at least in part both the plunger blocking position and the plunger pass position, means for preventing complete removal of the plunger during normal opening movement including clip means slidably mounted in the housing movable from a first position passing the plunger obstructions to a second position blocking one of said plunger obstructions, means to prevent the slides from being easily removed from the housing slots including an integral projection on one side of the slides, a plurality of grooves on one side of the housing slots adapted to releasably receive the slide projection, and a plurality of grooves on the other side of the housing slots adapted to releasably receive the slide projection whereby the slide projection will be engaged in one of the plurality of grooves regardless of the rotational position of the slides in the housing slots.

17. A padlock, comprising: a housing, a plurality of generally parallel slots in the housing, a plunger bore extending in the housing transverse to and interconnecting the slots, said slots each having an axis all lying in a common plane, a plunger slidably received in the housing plunger bore having a plurality of obstructions thereon, a plurality of slides in the housing slots each having at least one plunger blocking position and one plunger pass position, first slot means in the slides defining at least in part both the plunger blocking position and the plunger pass position, said plunger having a "U" shaped portion projecting from the housing with the "U" shaped portion lying in a portion plane, the "U" shaped portion having a free end receivable in a latching hole in the housing, said slots in the housing and the latching hole lying in a common plane, and said slots common plane lying in the "U" shaped portion plane.

18. A padlock as defined in claim 17, wherein the housing has a small boss lying in the common plane in which the latching hole is formed to reduce the size of the housing and the length of the slots.

19. A padlock as defined in claim 17, including means for preventing removal of the plunger during normal use including clip means slidably mounted in the housing movable from a first position passing the plunger obstructions to a second position blocking one of said plunger obstructions, a clip slot in the housing for receiving the clip means, said clip slot being substantially closed at one end to block inward movement of the clip means and thereby define the second blocking position of the clip means, said clip means slot lying in said common plane.

20. A combination lock, comprising: a housing, a plurality of generally parallel slots in the housing, a plunger bore extending in the housing transverse to and interconnecting the slots, a plunger slidably received in the housing plunger bore having a plurality of obstructions thereon, a plurality of slides in the housing slots each having at least one plunger blocking position and one plunger pass position, the ends of at least one of the slides having removable dimples indicating the pass position of the slides to temporarily prevent the user from forgetting the lock combination during a period of training.

21. A combination lock as defined in claim 20, wherein the slides have three positions, two blocking positions and one pass position, said slides including a center pass slide and a side pass slide, said dimples being only one end of the side pass slides.

22. A combination lock, comprising: a housing, a plurality of generally parallel slots in the housing, said slots each having an axis all lying in a common plane, a plunger bore extending in the housing transverse to and interconnecting the slots, a plunger slidably received in the housing plunger bore having a plurality of obstructions thereon, a plurality of slides in the housing slots each having a slot means defining at least one plunger blocking position and one plunger pass position, said slot means in all the slides having an equal length on both sides of a center position of the slides so that all slides have the same length of travel from both sides of their central positions.

23. A method of operating a combination lock of the type having a housing, a plurality of generally parallel slots in the housing, a plunger bore extending in the housing transverse to and interconnecting the slots, a plunger slidably received in the housing plunger bore having a plurality of obstructions thereon, a plurality of slides in the housing slots each having at least one plunger blocking position and one plunger pass position, the ends of at least one of the slides having removable dimples indicating the pass position of the slides to temporarily prevent the user from forgetting the lock combination during a period of training, including the steps of operating the lock with the dimples in situ during a period of training, and thereafter removing the dimples after the period of training.

* * * * *